US009199780B2

(12) United States Patent
Azani

(10) Patent No.: US 9,199,780 B2
(45) Date of Patent: Dec. 1, 2015

(54) DEVICE FOR STORING AND MIXING SUBSTANCES

(76) Inventor: Adam Azani, Deutschland (DE)

( * ) Notice: Subject to any disclaimer, the term of this patent is extended or adjusted under 35 U.S.C. 154(b) by 0 days.

(21) Appl. No.: 13/989,225

(22) PCT Filed: Nov. 22, 2011

(86) PCT No.: PCT/EP2011/070617

§ 371 (c)(1),
(2), (4) Date: Aug. 6, 2013

(87) PCT Pub. No.: WO2012/069441

PCT Pub. Date: May 31, 2012

(65) Prior Publication Data

US 2013/0306498 A1 Nov. 21, 2013

(30) Foreign Application Priority Data

Nov. 26, 2010 (DE) ..... 20 2010 015 932 U

(51) Int. Cl.

| | |
|---|---|
| ***B65D 81/32*** | (2006.01) |
| ***B65D 1/04*** | (2006.01) |
| ***B65D 35/22*** | (2006.01) |
| ***B65D 41/04*** | (2006.01) |

(52) U.S. Cl.

CPC ..... *B65D 81/3216* (2013.01); *B65D 1/04* (2013.01); *B65D 35/22* (2013.01); *B65D 41/0414* (2013.01); *B65D 81/3227* (2013.01); *Y10T 29/49826* (2015.01)

(58) Field of Classification Search

CPC ..... C12M 23/08; C12M 23/38; C12M 23/34; B65D 81/3216; B65D 1/04

USPC ..... 206/219, 221; 215/DIG. 8, 6; 222/145.1, 222/145.5

See application file for complete search history.

(56) References Cited

U.S. PATENT DOCUMENTS

| | | | | | |
|---|---|---|---|---|---|
| 4,772,558 | A * | 9/1988 | Hammann | ..... | 435/304.2 |
| 5,102,016 | A * | 4/1992 | Ball et al. | ..... | 222/145.3 |
| 5,232,108 | A * | 8/1993 | Nakamura | ..... | 215/6 |
| 5,553,727 | A * | 9/1996 | Molinaro | ..... | 215/44 |
| 5,588,550 | A * | 12/1996 | Meyer | ..... | 220/525 |
| 6,581,792 | B1 * | 6/2003 | Limanjaya | ..... | 215/252 |

(Continued)

FOREIGN PATENT DOCUMENTS

| | | |
|---|---|---|
| CN | 1968725 | 12/2002 |
| GB | 2293157 A | 3/1996 |
| WO | WO 03006320 A1 | 1/2003 |
| WO | WO 2010035086 A1 | 4/2010 |

OTHER PUBLICATIONS

English Abstract of CN 2387063 published Jul. 12, 2000.

(Continued)

*Primary Examiner* — Steven A. Reynolds
*Assistant Examiner* — King M Chu
(74) *Attorney, Agent, or Firm* — J.A. Lindeman & Co., PLLC

(57) ABSTRACT

Device for storing and mixing substances (10) comprising a container (14) which has an open end (16) and a closed end (18) and a cap (12) which is arranged at the open end (16) of the container (14), characterized in that the container (14) has at least two chambers (20) which are separated from each other by at least one wall (22), wherein the at least one wall (22) extends from the closed end (18) to the open end (16) of the container (14), and at least one projecting element (24) is constructed in the cap (12) in such a manner that the at least two chambers (20) can be closed by the projecting element (24) in the region of the open end (16) of the container (14).

7 Claims, 7 Drawing Sheets

(56) References Cited

U.S. PATENT DOCUMENTS

| | | | | |
|---|---|---|---|---|
| 7,021,481 | B2 * | 4/2006 | St. Germain et al. | 220/254.2 |
| 2013/0306498 | A1 * | 11/2013 | Azani | 206/219 |

OTHER PUBLICATIONS

English Abstract of CN 2818341 published Sep. 20, 2006.
English Abstract of CN 2895266 published May 2, 2007.

* cited by examiner

Fig. 3a
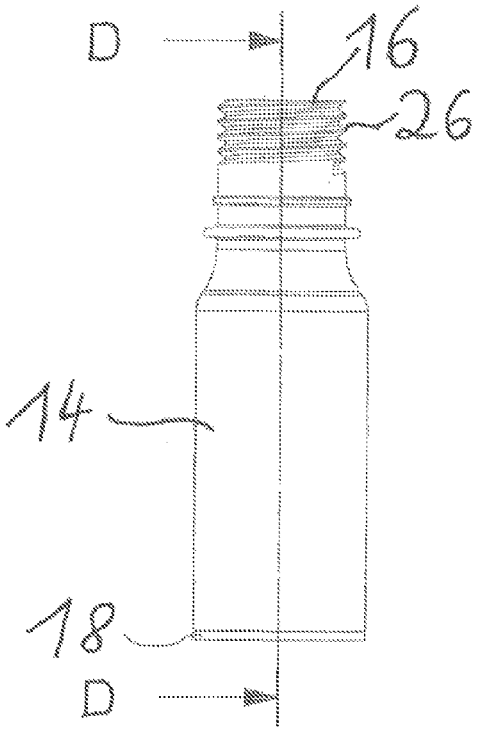
Fig. 3b
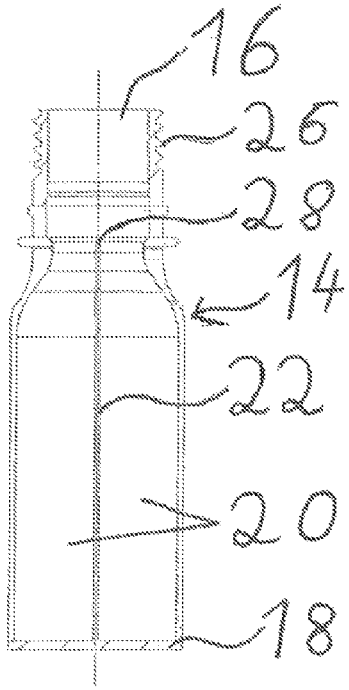
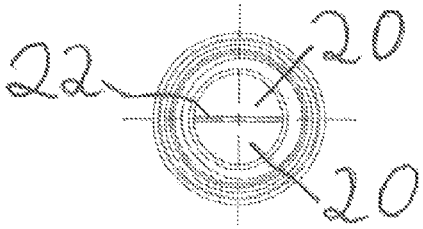
Fig. 3c

Fig. 4a
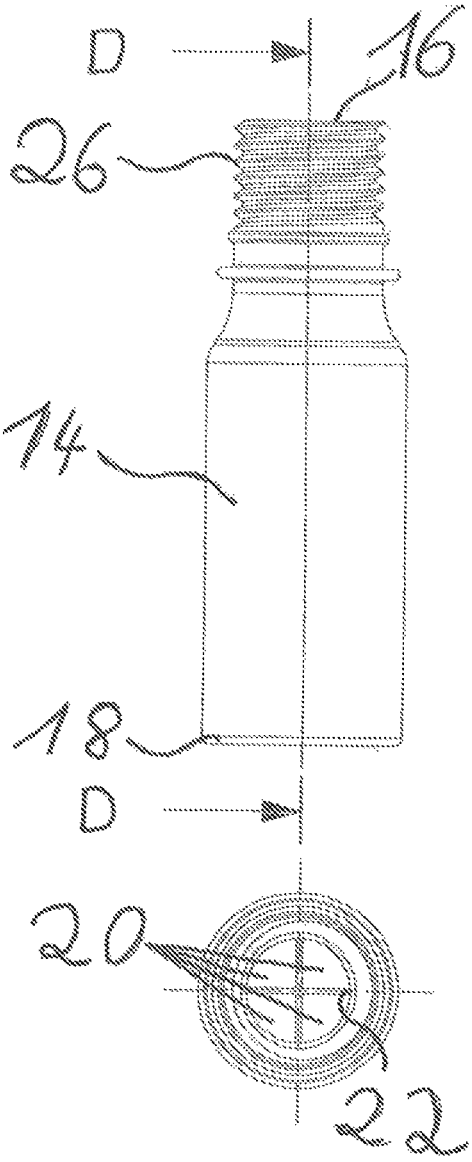
Fig. 4b
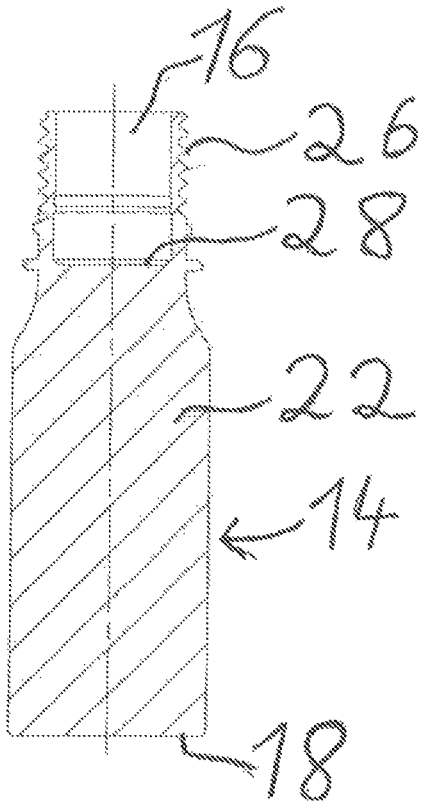
Fig. 4c 10
12
22
14

DEVICE FOR STORING AND MIXING SUBSTANCES

TECHNICAL FIELD

The present invention relates to a device which comprises a container and a cap and which allows different substances to be stored in a state isolated from each other and, for example, those substances to be mixed with each other before the time of use, before the substances are dispensed. Such devices may be used in various fields such as, for example, for cosmetics, pharmaceuticals, foodstuffs, food supplements or in the construction industry.

PRIOR ART

Many compositions of substances and recipes which contain different fluid and/or (powder-like) solid components are intended to be prepared only shortly before their use in order to ensure the desired effect of the combined components. For example, in a large number of medicaments for oral consumption the active substances are dissolved in a solvent before the administration. The patient must independently meter his medicaments, with an incorrect administration being able to have disadvantageous consequences.

In the field of food supplement media, there also exist a large number of components (such as vitamins) which are extremely sensitive. Complex active substance combinations which have interactions in solution with each other and which are consequently intended to be stored separately from each other until administration provide another example. During mixing shortly before use, however, a large number of errors which constitute a danger may occur. For instance, incorrect administration of medicaments or even mixing up active substances may have serious consequences.

In order to store and mix components, two chambers are usually provided in a container and store fluid and powder-like solid substances in a state isolated from each other.

Those substances are mixed with each other only shortly before use by means of a special mechanism. In U.S. Pat. No. 6,513,650, a flexible lid which has cutting means and which forms a second chamber is provided in the container closure above a first chamber. In order to mix the two components stored in the chambers, pressure is applied to the container and thus—by means of the cutting means—the second chamber is opened in order to release the contents thereof into the first chamber. However, such systems which are based on the separation of a membrane are technically complex in terms of their production and cannot be re-used.

Another possibility of constructing a mixed container is disclosed in U.S. Pat. No. 4,727,985. That container comprises a chamber for fluid in the lower portion and a chamber for powder-like substances in the upper portion. The chambers are separated by means of a stopper. A cap which has studs directed towards the interior of the container and which is secured by means of a snap-fit closure is provided as the closure. The cap being pressed down urges the stopper into the lower region of the container and thus allows the components to be mixed. That type of container also has the disadvantage that it is complex to produce, in particular in a re-usable configuration.

STATEMENT OF INVENTION

An object of the present invention is to provide a device which provides a simple and handy system for storing and mixing substances. A cost-effective production of the device is also intended to be possible, with the device particularly being intended to be constructed to be re-usable.

The device according to the invention comprises a container which has an open end and a closed end and a cap which is arranged at the open end of the container. The container further has at least two chambers which are separated from each other by at least one wall, with the wall extending from the closed end to the open end of the container. A projecting element is constructed in the cap in such a manner that the at least two chambers can be delimited by the projecting element in the region of the open end of the container. The container preferably has up to eight chambers.

The device according to the invention is configured owing to its construction in such a manner that practically any number of chambers may be provided in order to store different substances (or substance admixtures) separately from each other, and to mix them only shortly before they are used. Advantageously the container has a plurality of walls which extend from the closed end to the open end of the container and preferably form up to eight chambers inside the container. In a further preferable manner, from two to eight chambers (often 2, 3 or 4 chambers) can be provided in a container and each contain a different substance (or substance admixture). This allows combinations of components to be brought about which would not be readily possible in an individually packaged state. Consequently, novel additive combinations result, in particular in the field of food supplements.

The invention particularly relates to a device for storing and mixing substances comprising a container which has an open end and a closed end and a cap which is arranged at the open end of the container, characterized in that the container has at least two chambers which are separated from each other by at least one wall, wherein the at least one wall extend(s) from the closed end to the open end of the container and at least one projecting element is/are constructed in the cap in such a manner that the at least two chambers can be closed by the projecting element in the region of the open end of the container.

The invention also relates to a device for storing and mixing substances, wherein the cap is constructed in such a manner that it closes the at least two chambers of the container in a first position and, in a second position, connects the at least two chambers of the container to each other.

The invention also relates to a device for storing and mixing substances, wherein the cap is constructed in such a manner that it closes the at least two chambers in the first position in the region of the open end of the container by means of the projecting element.

The invention also relates to a device for storing and mixing substances, wherein the cap is constructed in such a manner that, in a second position of the cap, the at least two chambers are connected in the region of the open end of the container, wherein the cap further prevents a connection of the container in an outward direction.

The invention also relates to a device for storing and mixing substances, wherein the cap is constructed in such a manner that, in a third position of the cap, the open end of the container is released.

The invention also relates to a device for storing and mixing substances, wherein the cap and/or the projecting element constructed therein is/are constructed in such a manner that, in a third position, the cap can be removed from the open end of the container.

The invention also relates to a device for storing and mixing substances, wherein the cap is constructed as a screw type closure, snap-fit closure or a clip-lock.

The invention also relates to a device for storing and mixing substances, wherein the cap is constructed so as to be able to be engaged in at least two positions.

The invention also relates to a device for storing and mixing substances, wherein the container and/or cap is/are produced from glass and/or plastics material. Both preferably comprise plastics material.

The invention also relates to a device for storing and mixing substances, wherein the container has from two to eight chambers, in particular from two to four chambers. The device often has two or three chambers. Those chambers may be of the same size but they may also have different volumes.

The invention also relates to a method for producing a device as described above, wherein a container (14) and a cap (12) are formed from a suitable material (for example, plastics materials such as polyethylene, polypropylene, polycarbonate, PET or other copolymers) and the two components are then connected.

The chambers of the device may further be configured in such a manner that the mixing ratios of the individual substances can be predetermined and consequently errors in terms of metering can be avoided.

The invention also relates to the use of the above-mentioned device for providing active substances, in particular at least two different drugs or active substances.

The device further affords the advantage that the sterility of the medicament can always be achieved even if the end consumer is not in a sterile environment. This is an important aspect particularly in less-developed countries which have hardly any or do not have sterile water.

The device can be constructed, for example, as a cost-effective disposable packaging if the sterility is of paramount importance. However, it can also be used as a reusable packaging if the combinations of components are used for regular consumption, for example, of a plurality of medicaments for relatively old patients. The reusable construction of the device according to the invention constitutes an advantage over the solutions known from the prior art which initiate a mixing operation by means of a membrane which can be perforated. However, that perforation of the membrane is not reversible and the container is consequently no longer reusable. The container proposed according to the invention is further simpler to construct and more cost-effective to produce in relation to membrane-based systems.

In an advantageous manner, the cap may take up, for example, three different predetermined positions. In a first position, the cap closes the at least two chambers in the region of the open end of the container by the (at least one) projecting element. Consequently, the substances can be stored separately and in a state isolated from each other in the at least two chambers, which is particularly advantageous in the combination of substances which interact with each other. At the same time, the cap closes the container itself and allows air-tight closure which is suitable for storing the substances in the at least two chambers.

In a second position, the cap is configured in such a manner that a connection between the at least two chambers is provided in the region of the open end of the container, wherein the cap and the projecting element constructed therein further prevent a connection in an outward direction.

In the present context, the term "outward direction" is intended to refer to the environment outside the container. That position of the cap may be reached, for example, by partially lifting or withdrawing the cap, wherein an empty space is formed between the closure of the chamber wall and the projecting element of the cap. The mixing of the substances stored in the chambers may then be achieved by shaking the device, wherein the cap still closes the container in that position (in an outward direction).

In a third position, the open end of the container is released by the cap and/or the projecting element formed therein. In an advantageous manner, the cap and/or the projecting element formed therein is/are removable (or open) in the third position from the open end of the container. That handy and flexible system for storing and mixing substances allows the separate storage of substances until use, and those substances stored separately from each other can be mixed with each other at any location in a few seconds.

Preferably, the cap is further constructed as a screw type closure, snap-fit closure or clip-lock closure in order to close the container in an air-tight manner. To that end, the necessary elements, such as a thread, indentations or clip holders, are also naturally provided on the container. The cap and the container may further have closure mechanisms so that the cap engages in at least two positions. This makes handling the device easier during the transition from the closed state, in which the substances are stored separately from each other, to the intermediate state, in which a connection between the chambers is produced and the substances can be mixed.

The container and/or the cap is/are further produced, for example, from glass and/or plastics material, wherein the cap is preferably produced from a plastics material, for example, the above-mentioned ones. In this regard, the selection of the material is intended to be adapted to the application, respectively. For instance, a sterile material should be used for medical applications, in particular infusion solutions or the like. In the case of corrosive substances which can attack the container wall, however, more robust materials are advantageous.

DESCRIPTION OF THE DRAWINGS

The invention is set out in greater detail with reference to the drawings, in which:

FIG. 1*a* is a side view of a device for storing and mixing substances (for example, pharmaceutical container having a circular base face);

FIG. 1*b* is a cross-section of the device for storing and mixing substances along A-A according to FIG. 1*a;*

FIG. 3*a* is a detailed view of a container which can be closed by a screw type closure and which has two chambers;

FIG. 3*b* is a cross-section of a container having two chambers along D-D according to FIG. 3*a;*

FIG. 3*c* is a top view of the container which can be closed by a screw type closure and which has two chambers according to FIG. 3*a;*

FIG. 4*a* is a detailed view of a container having four chambers;

FIG. 4*b* is a cross-section of a container having four chambers along D-D according to FIG. 4*a;*

FIG. 4*c* is a top view of the container which can be closed by a screw type closure and which has four chambers according to FIG. 4*a;*

CONSTRUCTION VARIANTS

Figure 10:
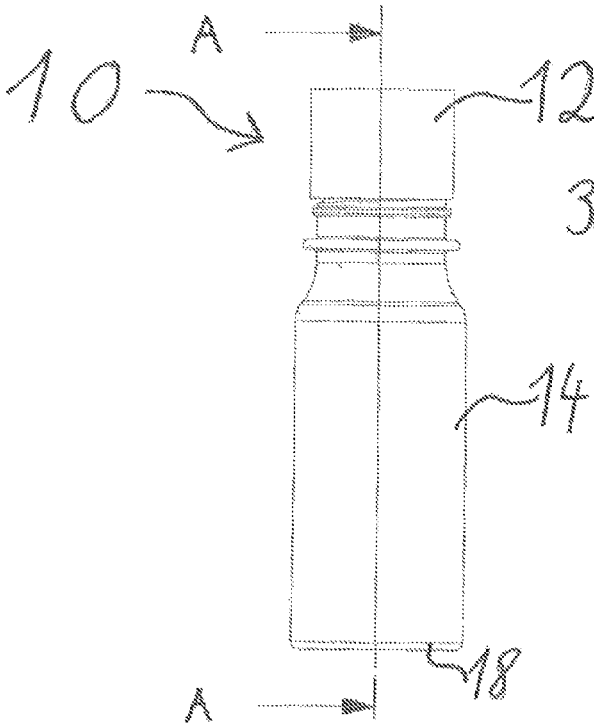
Figure 16:
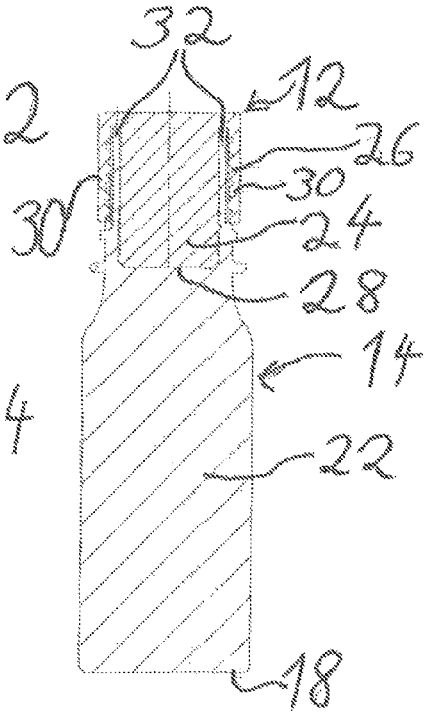

FIG. 1*a* illustrates a device for storing and mixing substances 10 which comprises a container 14 and a cap 12. The container 14 may be of different forms and sizes. Thus, depending on the use and size, the container may contain quantities in the order of magnitude of a few kilograms, a few grams, a few milligrams or a few micrograms. As can be seen in FIG. 1*a*, the form of the container 14 may particularly be a cylindrical shape having a round base face. Any other conceivable shaping is also possible.

The container 14 is further closed at one end 18 and open at the other end 16, with the open end or the opening 16 providing for a closure mechanism, at which a removable cap 12 can be received. In one embodiment of the invention, for example, a thread 26 which is provided on the opening 16 of the container 14 and in the cap 12 may form a screw type closure.

The sectional view in FIG. 1*b* illustrates the inner space of the container 14 along the line of section A-A. In this instance, a wall 22 extends from the closed end 18 to the open end 16 of the container which delimits two chambers 20 in this embodiment, as can be seen in FIG. 2*b*. Two different substances or components can be stored separately from each other in the chambers 20. Thus, for example, one chamber 20 may contain a fluid whilst the other chamber 20 contains a powder.

In the embodiment shown in FIG. 1*b*, a wall 22 is provided to form two chambers 20 inside the container 14. However, a plurality of walls 22 may be constructed inside the container and may then delimit more than two chambers 20, preferably up to eight chambers 20. FIGS. 3*a*, 3*b*, 3*c* and 4*a*, 4*b*, 4*c* show different embodiments inside the container 14 with differently arranged walls 22 which form two or four chambers 20.

The construction of individual chambers 20 allows substances of different types, that is to say, fluids and/or powders, to be stored separately from each other before they can be mixed with each other shortly before use. Furthermore, the position of the walls 22 may be freely selected in the container interior. Thus, the volume and the capacity of each chamber 20 can be adapted flexibly to the mixing relationships of the substances stored in the chambers 20 and it is possible to ensure error-free enrichment of, for example, medicaments, food supplements or other chemically reacting substances. That is to say, for example, if more fluid than powder is used, the wall 22 or partition wall is positioned and adapted inside the container in such a manner that no empty spaces are produced in the chambers, which substantially increases the efficiency of the packaging.

In order to store at least two components in the container 14 with at least two chambers 20 in a state isolated from each other, a cap 12 is further provided at the open end 16 of the container 14. In FIG. 1*b*, the cap 12 is in a first position, where it closes the container 14 and the at least two chambers 20 so that no connection exists between the substances in the chambers 20. There is preferably constructed in the cap 12 a projecting element 24 which, in the first position of the cap 12, fills the inner space at the opening or the open end 16 of the container 14 and which closes the closure 28 of the wall 22 in a precisely fitting manner. The cap 12 is further constructed in such a manner that, in the case of a screw type closure, an inner thread 26 is provided on the side wall 30. A recess 32 and the inner thread 26 allow the cap 12 to be screwed onto the container 14 with the outer thread 26 and to be closed in an air-tight manner. The cap 12 therefore acts in the manner of a stopper which seals the container 14 and the chambers 20 located therein.

Figure 2A:
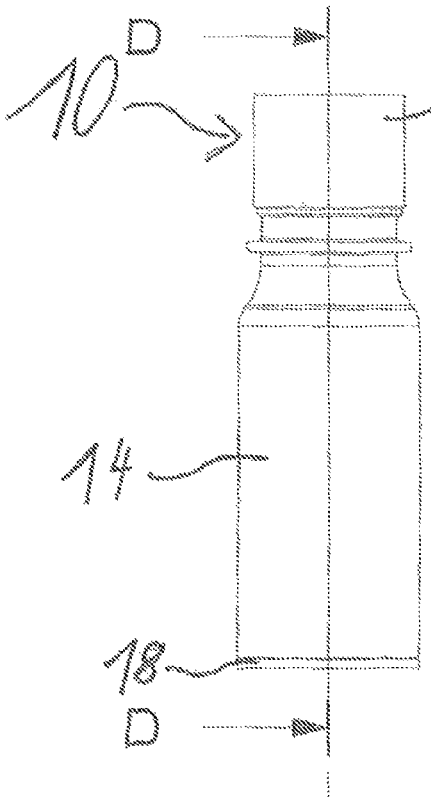
FIG. 2*a* is a side view of a device for storing and mixing two substances having two chambers.
Figure 2B:
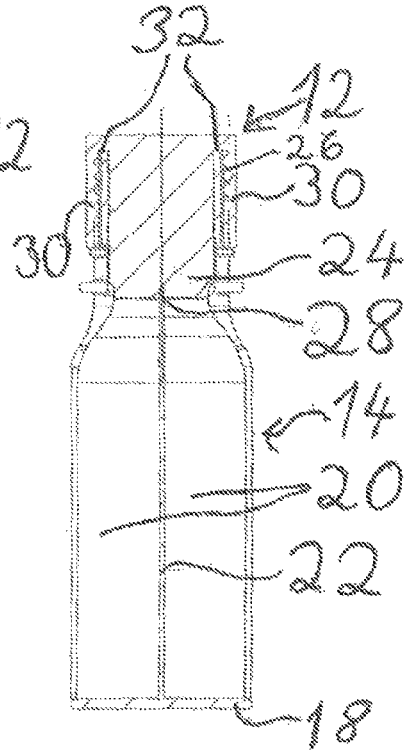
FIG. 2*b* is a cross-section of the device having two chambers for storing and mixing substances along D-D according to FIG. 2*a;*

FIG. 2*a* also shows a device for storing and mixing substances 10. FIG. 2*b* is a cross-section along D-D and illustrates the construction of the chambers 20 by means of the wall 22 inside the container 14. It can further be seen how the projecting element 24 of the cap 12 isolates the chambers 20 from each other and seals the inner space of the container 14 in the outward direction, that is to say, from the environment of the container 14.

FIG. 2 illustrates the device for storing and mixing substances 10 in the closed state, that is to say, the cap 12 is in a first position and seals both the container 14 in the outward direction and the individual chambers 20 inside the container 14. In this state, the substances located in the chambers 20 can be stored in a state isolated from each other.

FIG. 1 illustrates the device for storing and mixing substances 10 in a state in which the cap 12 is in an unscrewed position but still does not allow a connection between the chambers 20. Consequently, this position corresponds to an intermediate position between a closed first position and a second position in which a connection is produced between the chambers 20.

Shortly before the contents of the container 14 in which the different substances are stored separately from each other in chambers 20 are used, those substances can be mixed with each other. To that end, the cap 12 is moved into a second position which, for example, is characterized by a marking or a groove on the container 14. In that second position, the cap 12 continues to close the container 14 but a connection between the chambers 20 is released. If the cap 12 is in the second position, an empty space is produced between the projecting element 24 and the wall 22 in the region of the opening 16 of the container 14. This is a critical point because the necessary empty space is dependent on the solubility of the materials or substances used.

The connection between the chambers 20 and the empty space allow, for example, the substances stored separately from each other in the chambers 20 to be mixed, for example, by the container 14 being shaken. Such a mechanism for storing and mixing substances has the advantage that, for example, sensitive active substances which rapidly die or which are incompatible and react with each other, can readily be enriched in a fresh manner.

In the final step, the cap is moved into a third position which opens the container 14 at the open end 16 in order to discharge the contents. Preferably, in this third position, the cap 12 is removed from the container 14 which can be constructed in a re-closable manner.

In an advantageous embodiment, the container 14 and the cap 12 are constructed as individual members, it being possible to produce the container 14 from plastics material or glass and the cap 12 preferably being produced from plastics material. Plastics materials which can be used to produce the device according to the invention may include, for example, polyethylene, polypropylene, PVC and silicone, which are processed, for example, by means of deep-drawing, injection molding methods or blow molding methods. Depending on the field of application of the device, the material is intended to be adapted to the circumstances. Thus, for example, with regard to the sterility in medical applications, a material which also allows storage in a sterile environment should be used.

Any known closure mechanism with which a container 14 can be closed may be used in the context of the present invention. A cap 14 which can be removed completely or partially is preferably used in order to seal the contents of the container 14 in the closed state and to discharge them in the open state. Advantageously, the closure mechanism is constructed as a screw type, clip-lock or snap-fit closure. For applications with dangerous contents, in particular in the medical field, additional child-proof securing means may also be provided. This is usually achieved by means of a closure which requires unusual movements or a combination of simultaneous or successive movements which in all probability would not occur to a small child without instructions or which are scarcely possible for anatomical reasons.

Figures 5A, 5B:
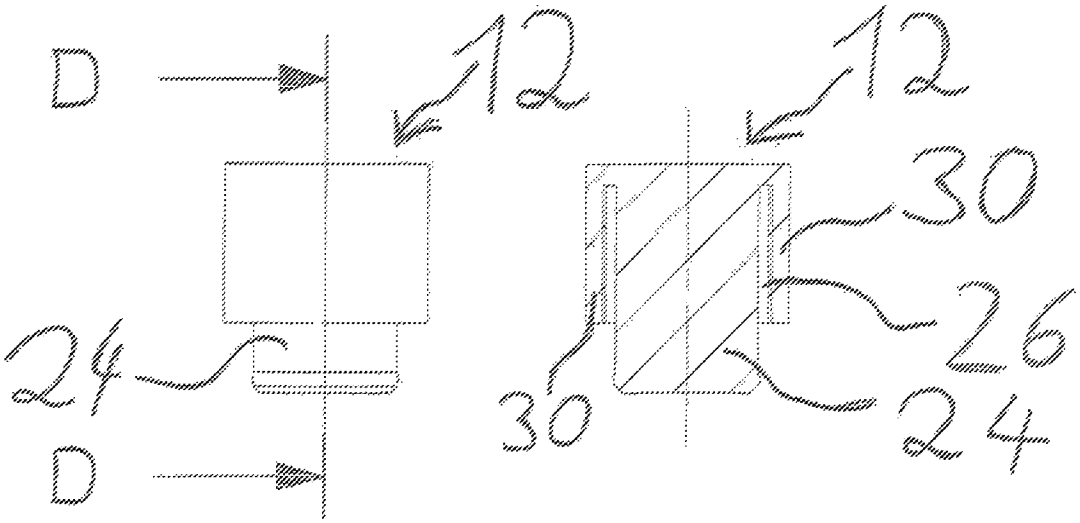
FIG. 5*a* is a detailed view of a cap having a projecting element.
FIG. 5*b* is a cross-section of a cap having a projecting element along D-D according to FIG. 5*a;*

FIGS. 5*a* and 5*b* show an embodiment of the cap 12 in detail. For instance, as described above, a projecting element 24 which fills the inner space at the opening 16 of the container 14 in the first position and which closes the closure 28 of the wall 22 in a precisely fitting manner is preferably constructed in the cap 12. Thus, the chambers 20 inside the container 20 can be isolated from each other if the cap 12 is in the first position. The closure may be constructed as a screw type closure having an inner thread 26 on the side wall 30 of the recess 32 in the cap 12 and having an outer thread 26 on the container 14. This allows the cap 12 to be screwed onto the container 14 in the manner of a lid which closes the container in an air-tight manner. The cap 12 and the projecting element 24 therefore act as a stopper which seals the container 14 and the chambers 20 therein.

In this embodiment, the second and third position of the cap, that is to say, the positions for mixing and opening, can be reached by unscrewing. For example, a marking or a groove in the region of the open end 16 of the container 14 may indicate the second position for mixing the individual substances. In the third position, the cap 12 is completely unscrewed and consequently opens the container 14.

Figures 6A, 6B:
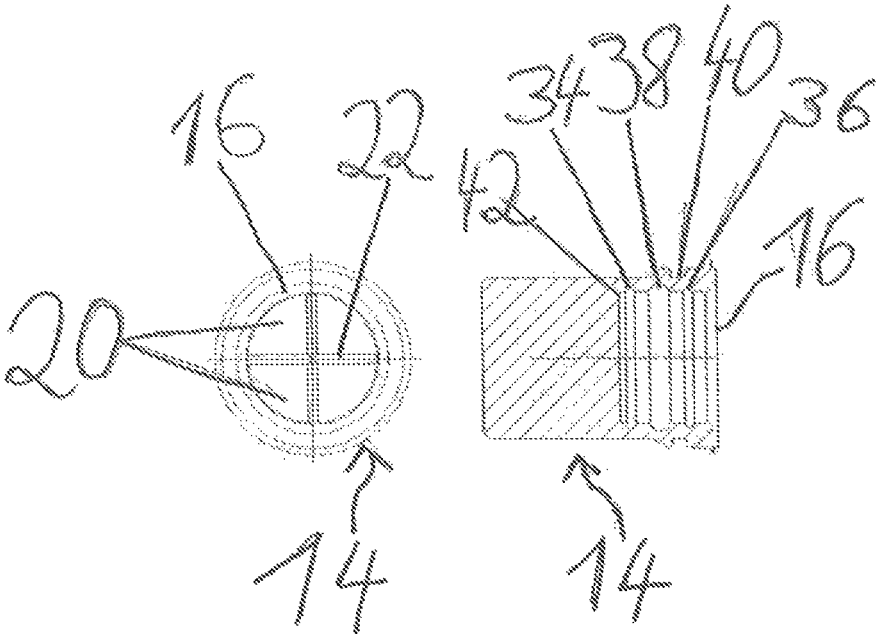
FIG. 6*a* is a top view of another embodiment of a container having four chambers and a snap-fit closure.
FIG. 6*b* is a cross-section of another embodiment of a container having four chambers and a snap-fit closure.
Figure 6C:
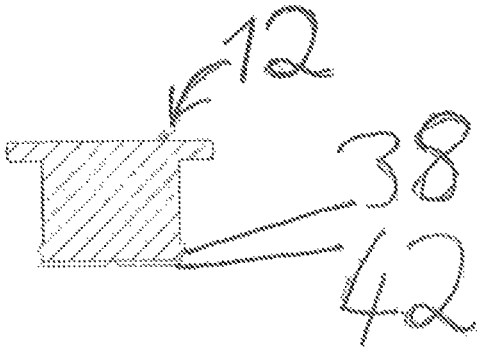
FIG. 6*c* is an illustration of another embodiment of a cap having a snap-fit closure.
Figure 7:
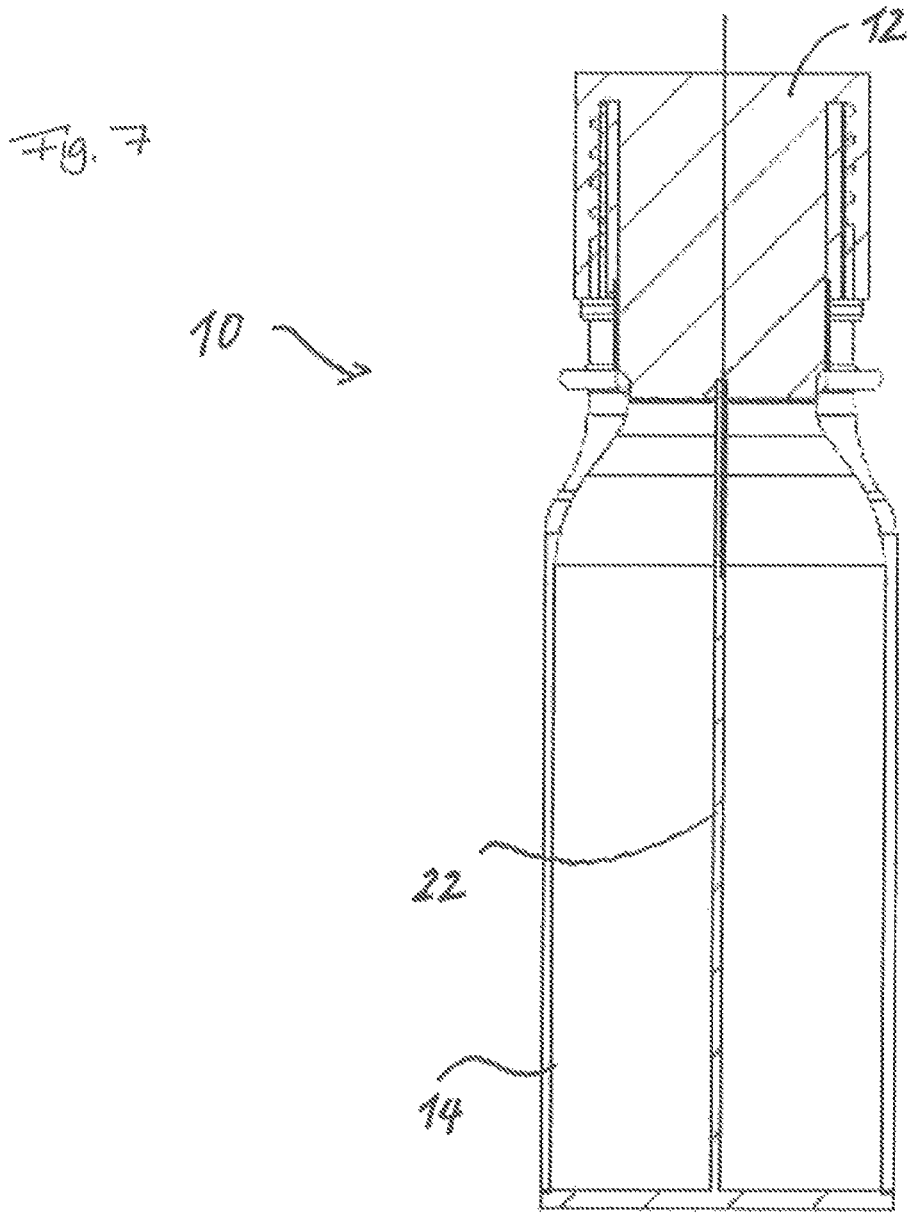
FIG. 7 is a side view of the device 10.

FIGS. 6*a-c* show another embodiment, with the closure mechanism being in the form of a snap-fit closure. FIG. 6*a* is a top view of a container 14. This is constructed, unlike in the embodiments of the container illustrated in FIGS. 1 to 5, without a conical extent in the upper region of the container 14, that is to say, in the region of the opening 16. Furthermore, there are provided a total of four individual chambers 20, in which various substances can be received. FIG. 6*b* is a side view of the container 14, with the elements of the snap-fit closure being apparent in the container 14. Indentations 34, 36 which are formed in an annular manner over the entire periphery of the container 14 are provided in the region of the opening 16 of the container 14.

In the present embodiment, the cap 12 is in the form of a stopper, wherein a projection 38 is provided in an annular manner along the periphery of the cap 12 at the lower end of the cap 12 which is directed towards the container interior. That projection 38 cooperates with the indentations 34, 36 of the container 14 in such a manner that the projection 38 engages in the position of the indentations 34, 36, respectively. If the projection 38 of the cap 12 is in the first indentation 34, this corresponds to the closed state of the container 14. Consequently, both the container 14 and the individual chambers 20 are closed and the substances are stored separately from each other in the individual chambers 20.

In order to start the mixing operation, the cap 12 in the form of a stopper is withdrawn into the position of the second indentation 36. As a result, a connection between the individual chambers 20 in the container 14 is produced and there results an empty space in the region of the opening 16 of the container 14. By being shaken, the substances stored in a state isolated from each other in the chambers 20 can be mixed with each other. Subsequently, the user can access the mixed content of the container 14 by withdrawing the cap 12.

The curvature 40 in the container 14 serves to compensate for pressure when the cap 12 is withdrawn or pressed in so that, on the one hand, an underpressure may be prevented and, on the other hand, air may be discharged. The conical closure 42 of the cap 12 and the container 14 allow the cap 12 to be engaged at the sides of the container 14 and the chambers 20 in order to prevent the substances from being discharged inside the container 14.

The device according to the invention is used in various fields, in which isolated storage and mixing of components may be necessary shortly before use. Thus, the device according to the invention can be used in applications with sensitive active substances which quickly die and therefore must be freshly enriched. Examples of this are food supplements on the basis of vitamin B12 or more complex combinations containing folic acid, fatty acids, co-enzymes or the like. The multi-chamber system further allows complex combinations comprising more than two, preferably up to eight, substances. In the pharmaceutical field, where the mixing ratio is extremely critical, the device according to the invention can ensure error-free enrichment with predetermined quantity ratios. Finally, substances which interact chemically can also be introduced into the device according to the invention. In this context, particularly industrial products such as, for example, two-component adhesives, or cosmetic products such as, for example, hair dyes, are of interest.

In conclusion, the device according to the invention provides a simple and flexible device for storing and mixing substances which, on the one hand, allows the separate storage of substances and allows those substances to be mixed in a few seconds at any location.

LIST OF REFERENCE NUMERALS

10 Device for storing and mixing substances
12 Cap
14 Container
16 Opening
18 Closed end
20 Chambers
22 Wall
24 Projecting element
26 Thread
28 Closure of the wall
30 Side wall of the cap
32 Recess of the cap
34 First indentation
36 Second indentation
38 Projection of the cap
40 Curvature
42 Conical closure

The invention claimed is:

1. A device for storing and mixing substances comprising:
a container which has
an open end and
a closed end and
a cap which is arranged at the open end of the container,
wherein the container has at least two chambers which are separated from each other by at least one wall,
wherein the at least one wall extends from the closed end to the open end of the container, and at least one projecting element is constructed in the cap in such a manner that the at least two chambers can be closed by the projecting element in the region of the open end of the container, and wherein the cap is constructed in such a manner that it closes the at least two chambers of the container in a first position and, in a second position of the cap, connects the at least two chambers to each other in the region of the open end of the container and in a third position of the cap, the open end of the container is released, wherein the cap further prevents a connection of the container in an outward direction, wherein the cap is constructed as a snap-fit closure, and wherein the container comprises a first indentation and a second indentation which are formed in an annular manner along the periphery of the container at the open end of the container and wherein the cap includes a projection in an annular manner along the periphery of the cap at a lower end of the cap and which is directed toward the container interior, the projection of the cap cooperating with the indentations such that the projection of the cap engages the first indentation when the cap is in the first position and the projection of the cap engages the second indentation when the cap is in the second position.

2. The device for storing and mixing substances as claimed in claim 1, wherein at least one of the cap and the projecting element constructed therein is constructed in such a manner that, in a third position, the cap can be removed from the open end of the container.

3. The device for storing and mixing substances as claimed in claim 1, wherein the cap is constructed so as to be able to be engaged in at least two positions.

4. The device for storing and mixing substances as claimed in claim 1, wherein at least one of the container and cap is produced from at least one of glass and plastics material.

5. The device for storing and mixing substances as claimed in claim 1, wherein the container has from two to eight chambers.

6. A method for producing the device as claimed in claim 1 comprising:

producing the container from plastics material or glass;

producing the cap from plastics material; and connecting the cap and the container to each other.

7. A method of using the device of claim 1 comprising:

moving the cap of the device from a first isolation position to a second released position, wherein the first position includes a connection between a first chamber of the device storing a first substance and a second chamber of the device storing a second substance and wherein the second position releases the connection between the first chamber of the device and the second chamber of the device;

mixing the first substance and the second substance in the device;

moving the cap of the device to a third position that opens the device; and discharging the mixture of the first substance and the second substance.

* * * * *